US005943978A

United States Patent [19]

Garnier

[11] Patent Number: 5,943,978

[45] Date of Patent: Aug. 31, 1999

[54] INFLATABLE BOAT WITH DETACHABLE HULL

[75] Inventor: Gérard Garnier, Rochefort sur Mer, France

[73] Assignee: Zodiac International, France

[21] Appl. No.: 09/113,007

[22] Filed: Jul. 9, 1998

[30] Foreign Application Priority Data

Jul. 10, 1997 [FR] France ..... 97 08783

[51] Int. Cl.[6] ..... B63B 3/38

[52] U.S. Cl. ..... 114/345

[58] Field of Search ..... 114/345, 140; 441/40

[56] References Cited

U.S. PATENT DOCUMENTS

| | | | |
|---|---|---|---|
| 2,743,510 | 5/1956 | Mauney et al. | 114/345 |
| 3,566,425 | 3/1971 | Welty | 114/345 |
| 4,660,497 | 4/1987 | Cochran . | |
| 4,722,292 | 2/1988 | Marino et al. | 114/345 |

FOREIGN PATENT DOCUMENTS

| | | |
|---|---|---|
| 0743239 | 11/1996 | European Pat. Off. . |
| 2300878 | 9/1976 | France . |

*Primary Examiner*—Ed Swinehart

*Attorney, Agent, or Firm*—John S. Pratt; Kilpatrick Stockton LLP

[57] ABSTRACT

An inflatable boat (1) comprising laterally two inflatable buoyancy fenders (2) connected by a bottom (13) rigid at least transversely and by an underlying hull (4) presenting an approximately V transverse section, characterised in that a flexible bottom (16), lining the rigid bottom (3) and underlying it, is fixed in a sealed way to the fenders (2) and in that the aforementioned hull (4) is rigid at least in a central longitudinal strip (6) in the shape of a V gutter and is constituted by several sections (11) assembled longitudinally end to end in a removable way and held with the help of removable fixing means (8).

13 Claims, 3 Drawing Sheets

INFLATABLE BOAT WITH DETACHABLE HULL

FIELD OF THE INVENTION

The present invention concerns improvements made to inflatable boats comprising laterally two inflatable buoyancy fenders connected by a rigid bottom at least transversely and by an underlying hull presenting, in transverse section, approximately the shape of a V.

BACKGROUND OF THE INVENTION

Inflatable boats have known a very substantial growth because of the advantages which they present in respect of their buoyancy and their unsinkability in comparison with rigid hull boats. They are divided at present into two principal types according to the design of the hull Boats with a flexible hull, corresponding to the original type, comprising a hull which is constituted by a flexible canvas extending under the rigid bottom of the boat and a keel is interposed between the rigid bottom and the canvas in order to stretch it and give it, in transverse section, approximately the shape of a widely open V. The keel can be ordinary and, originally rigid, it is today often constituted by a fender, which is usually pneumatically inflatable. The main advantage of this type of boat lies in the small space which it occupies when it is dismantled, deflated and folded, which makes it easy to stow and transport. On the other hand, the lack of rigidity of its hull and especially the too open V shape of this hull give it mediocre characteristics of seaworthiness, particularly for course holding.

Boats with a rigid hull comprise a hull generally of synthetic material (reinforced composite material) whose peripheral edge is fixed, at the front and laterally, to an inflatable buoyancy fender. These boats retain the characteiristics of buoyancy and unsinkability of inflatable boats and in addition their rigid pronounced V shaped hull gives them good characteristics of seaworthiness, in particular for course holding. However, their major disadvantage lies in the rigid composition and casting of the hull in one piece (often manufactured all in one piece with the transom), which then forms a relatively heavy and bulky piece: the dismantling and deflation of the boat does not offer any substantial advantage for being stowed end transported, and these boats must usually be transported on specialised trailers. This significant disadvantage has limited the growth of boats with a rigid hull and has restricted this layout mainly to top-of-the-range boats.

SUMMARY OF THE INVENTION

The main object of this invention is to propose an improved layout for inflatable boats which, removes the respective previously quoted disadvantages of flexible hulls and rigid hulls, but simultaneously retains their respective advantages.

To this end, an inflatable boat such as mentioned in the preamble is characterised as being constructed in accordance with the invention, in that a flexible bottom, lining the rigid bottom and underlying it, is fixed in a sealed manner to the fenders and in that the said hull is rigid at least in a central longitudinal strip in the shape of a V gutter and is constituted from several sections assembled longitudinally end to end in a removable manner and held with the help of removable fixing means.

Thus, it is possible to separate the hull or the rigid components of the hull from the flexible parts of the boat; thus dismantled, they can be collected and stacked in a small volume of space. An inflatable boat of this type therefore retains the advantage of being able to be dismantled which was not presented by known boats equipped with a rigid hull cast in one piece. Boats complying with the invention can then be transported in conditions more or less similar to those of a boat with a flexible hull.

In a possible method of realisation, the hull is entirely rigid and fixed to the aforesaid fenders with the help of removable fastening means, as a consequence of which it is not essential to install a keel between the hull and the rigid bottom.

In another method of realisation, which is preferred, the hull is of the mixed type, part flexible and part rigid, and comprises, on the one hand, a central rigid longitudinal strip in the shape of a V gutter and, on the other hand, two flexible lateral strips arranged on either side of the said central strip, each of the flexible lateral strips being fixed on one side to a respective longitudinal edge of the rigid central strip with the help of removable fastening means and on the other side to the respective buoyancy fender. This layout depends on the fact that only the part of the hull which borders the point of the V is useful for ensuring navigational stability at sea. For this reason, only the central zone of the hull, that is to say the central longitudinal strip which includes the point of the V, needs to be made in a rigid form; the remaining part of the hull, that is to say the two longitudinal strips located on either side of the rigid central strip, can be made in any desired manner, for example in a flexible form.

In a very advantageous way in the latter case, the rigid bottom is provided with raised upward lateral edges and presents, in transverse section, approximately the shape of a V with a truncated point, the inclination of the aforesaid lateral edges being approximately identical to the inclination of the aforesaid two flexible lateral strips of the hull. As a consequence of this layout, each flexible lateral strip is partially supported against a rigid span and only the strip zone which is located between this rigid span and the rigid central strip of the hull keeps its full deformation capacity. The balance existing between the partial rigidity and the partial deformabilty of the hull is thus optimised. In particular, this balance seems to be optimised when, on each inclined side of the hull, the width of the side corresponding to the rigid central strip and tile width of the raised edge of the rigid bottom each represent approximately a third of the width of the aforesaid inclined side of the hull.

Because of the presence of the flexible parts of the hull which must be tensioned when the flexible strips of the hull are separate from the aforesaid flexible bottom, it is necessary to resort to a keel interposed between the bottom and the rigid central strip; preferably, to a keel of the pneumatic inflatable keel type which includes at least one pneumatically inflatable fender interposed between the bottom and the rigid central strip of the hull is resorted to, the composition of a pneumatic inflatable keel being well known in the prior art.

In another possible method of realisation, it may be that the two lateral flexible strips of the hull are constituted by the two lateral zones of the flexible bottom fitting the raised lateral edges of the rigid bottom and that the removable fastening means of the rigid central strip of the hull are located approximately at right angles to the connecting comers of the raised lateral edges and of the central portion of the rigid bottom, as a consequence of which the rigid central strip of the hull is held by the flexible bottom taut over the rigid bottom and it is possible not to install a keel.

In a standard manner, the removable fastening means may include a set of grooves provided on the two respective longitudinal edges of the rigid part of the hull and with raised keeper rings provided on the respective facing flexible supports.

With regard to the rigid bottom, it can be constituted from several panels assembled longitudinally end to end; these components can be dismantled and stacked in the same manner as the hull components. Or else the rigid bottom is a bottom inflatable under high pressure, which after deflation can be folded and/or rolled.

As a consequence of the previously quoted arrangements, one is in a position to construct an inflatable boat which, as a consequence of the presence of at least the rigid central strip of the hull, presents good seaworthiness characteristics, comparable to those provided by an entirely rigid hull.

On the other hand, the construction of the rigid part of the hull in the form of several segments assembled end to end, in the same manner as is the known practice for the rigid bottom formed from several panels assembled end to end (three or four units for each, in practice), enables their stacking, when dismantled, in a small space. Regarding the rest of the boat, it is made in a flexible form and therefore, after deflation, can be folded and rolled into a limited space. The stowing and transport of a boat thus constructed can be carried out in conditions close to those allowed by a boat with an entirely flexible hull.

Finally, another advantage, and not the least, resides in the simplification of the manufacture of the hull and in the reduction of its cost price. Indeed, the two flexible lateral strips of the hull in the methods of realisation resorted to, can be realised in the sealed coating fabric used for the manufacture of the inflatable fender and they are fixed to it by a standard technique of welding/adhesive. With regard to the rigid part of the hull, it can be manufactured in a synthetic material, such as a composite material with fibrous reinforcement which is currently used in marine construction. However, the toxicity of the products employed requires installations for ventilation and processing of the residues which are complex and expensive. The small dimensions of the rigid central strip of the mixed hull in accordance with the invention in the methods of realisation resorted to, compared with those of a traditional entirely rigid hull, leads to a reduction in these installations and therefore a notable reduction in the overall cost of the manufacture.

BRIEF DESCRIPTION OF THE DRAWING

The invention will be better understood by reading the following detailed description of certain methods of realisation given only as non-restrictive examples. In this description reference is made to the appended drawings in which.

DETAILED DESCRIPTION

Figure 1:
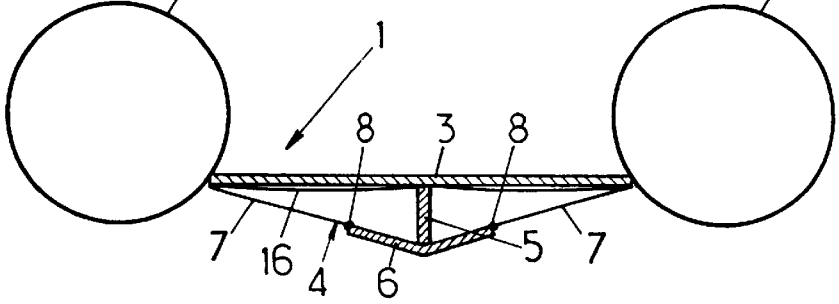
FIGS. 1 to 3 show, in a very schematic and simplified way, three possible realisation variants, in transverse section, of an inflatable boat complying with the invention.

Referring first to FIG. 1, an inflatable boat targeted by the invention, designated as a whole by the reference number 1, comprises laterally two inflatable buoyancy fenders which can meet at the front in order to present the general shape of a U open toward the rear of the boat. The two buoyancy fenders 2 are connected together at the rear by a transom (not shown) and underneath by a bottom 3, which is rigid at least transversely and which can to this effect be constructed in any appropriate way: a mat of rigid laths joined to each other, rigid panels fitted one into the next, bottom inflatable under high pressure, etc. Under the rigid bottom 3 extends an underlying hull 4 fixed to the fenders 2 and which is flexible (impermeable coated canvas) at least in part. Between the rigid bottom 3 and the hull 4 is interposed centrally a keel 5 intended to tighten the hull so as to impart to it, in transverse section, the general shape of a V; here too, the keel 5 can be shaped in different ways (rigid keel, pneumatically or hydrodynamically inflatable keel, etc).

Such bloats are widely known in numerous versions and do not need to be described in a more detailed manner within the scope of the present invention.

In accordance with the invention, the hull 4 is not entirely flexible as is the case in currently known boats with a flexible hull, but is of a mixed type, that is to say, part flexible and part hard.

To this effect, it comprises a central longitudinal strip 6 which is rigid (metallic, for example aluminium; synthetic material, for example a reinforced composite material) and which presents the shape of a V gutter, and the longitudinal profile of which is more or less curved upwards in its front part.

In addition, the hull 4 comprises two flexible lateral strips 7 (coated fabric) positioned respectively either side the rigid central strip 6; each of these flexible lateral strips 7 is fixed, on one side, to a respective longitudinal edge of the rigid central strip 6 and, on the other side, to the respective buoyancy fender 2.

The hull 4 thus constituted is tensioned by the keel 5 which is supported in the bottom of the rigid V gutter 6, as can be seen in FIG. 1. The connection of the flexible lateral strips 7 with the respective fenders 2 is a definitive assembly realised in a standard manner (adhesive, welding) in the same manner as for the canvas of a totally flexible hull of a standard boat.

The connection (in 8) of the flexible lateral strips 7 with the rigid central strip 6 can be realised in a form which can be dismantled, for example by a groove and keeper ring type of assembly: each longitudinal edge of the rigid strip 6 presents a groove with a narrow aperture in which is introduced the edge of the corresponding flexible strip which is equipped with a longitudinal keeper ring. Such a method of assembly, similar to that employed for fixing the lateral buoyancy fenders to the edge of the rigid hull in boats with an entirely rigid hull, presents the advantages of good mechanical resistance and easy detachability, rapid and not requiring a particular set of tools. However, these means of fixing 8 as aforementioned are not sealed and it is necessary, already from this point of view, to provide in addition sealing as will be described below.

The hull layout which has just been described enables the advantage of good seaworthiness characteristics due to the rigidity of the V point area, the only effective one in this respect, and the advantage of real detachability to be reconciled enabling, after folding and rolling, to construct a package which is easy to stow and transport.

Furthermore, this layout very easily brings together the various types of rigid bottom and keel which are currently used in inflatable boats.

As an example, it has been assumed that the inflatable boat 2 illustrated very schematically in FIG. 1 comprises a rigid bottom 3 formed from a mat of laths or an assembly of end to end panels, in wood or in a plastic material, while the keel 5 is a rigid keel constituted by an elongated piece of wood or plastic material introduced between the bottom 3 and the gutter 6.

Figure 2:
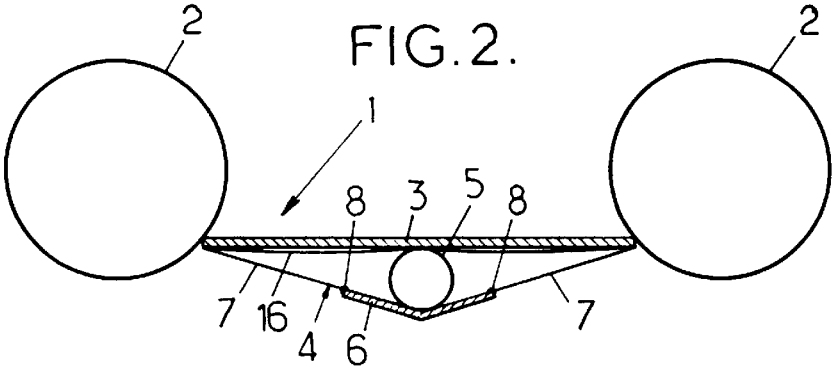

In FIG. 2, it has been assumed that the keel was of the inflatable type, constituted by an elongated fender interposed between the bottom 3 and the gutter 6; usually the fender forming the keel is with pneumatic inflation, but it can of course be inflated in any other way, particularly hydrodynamically.

Figure 3:
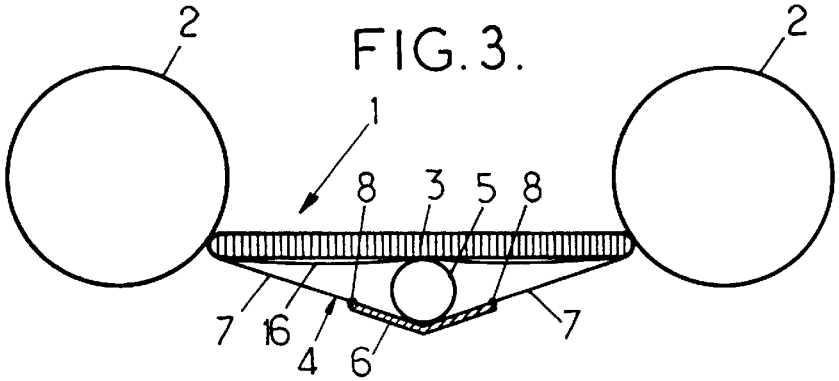

In FIG. 3, the keel 5 is always assumed to be of the inflatable type as in FIG. 2, but the bottom 3 is here shown very schematically as being a bottom inflatable under high pressure the use of which is at present widely developed (flat cushion formed from a canvas coated and sealed from the air, the two principal facing surfaces of which are connected by a multiplicity of flexible bracing strands).

Figure 4:
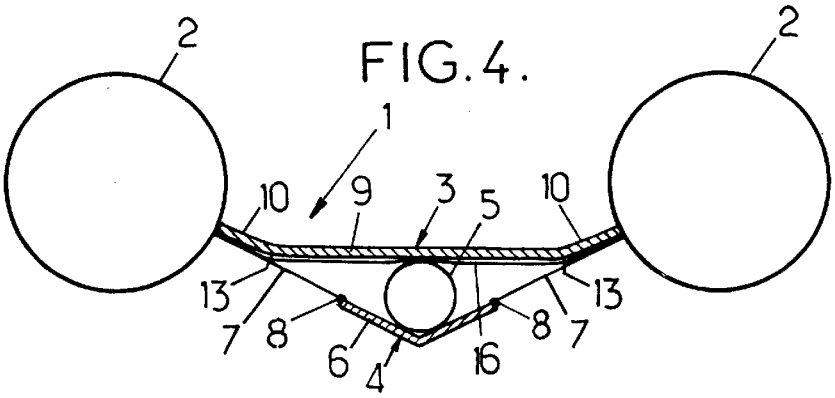
FIG. 4 shows in a very schematic and simplified way and in transverse section, a preferred method of realisation constituting a variant of the realisation method of FIG. 2.

Finally, in FIG. 4 is shown, in the same very schematic way, a preferred method of realisation which constitutes a variant of the method of realisation of FIG. 2 by the fact that, in conjunction with the pneumatic inflatable keel 5, recourse has been made to a rigid floor 3 with particular transverse conformation. The floor 3 is constituted, as is seen better in FIG. 6, by an assembly of panels 9 each extending, transversely, from one fender 2 to the other and positioned one after the other, with relative articulation jointing in accordance with a configuration known in the prior art. From each side, each panel 9 has its edges 10 raised upwards in an inclined position, so that the panel 9 presents the approximate shape of a V with a truncated point.

The inclination of the edges 10 of the panels 9 corresponds approximately to the inclination of the flexible lateral strips 7 of the hull 4, that is to say an inclination of 15 to 30° to the horizontal, preferably of the order of 20 to 25° in accordance with a standard layout. As a consequence of this arrangement, the flexible lateral strips 7 of the hull 4 are partially supported by the edges 10 of the panels 9; in this way the size of the totally free part of the flexible strips 7 is reduced while freedom is left between the V gutter 6 and the rest of the boat; the possibility of resonant vibration of the canvas 7 coming into rapid contact with successive waves is thus reduced.

Furthermore, the edges 10 of the panels 9 and the V gutters 7 of the hull 4 are dimensioned transversely in a manner for each to represent approximately a third of the transverse dimension of the corresponding side of the hull; in other words, each side of the hull 4 is constituted approximately for one third by the corresponding side of the rigid gutter 6, for one third by the portion of the flexible strip 7 which is free of support, and for one third by the portion of the flexible strip 7 which is supported against the edge 10 of the bottom 3 panels 9.

The rigid central strip 6 in the shape of a V gutter, is constituted, in accordance with the invention, not all in one piece, but in the form of several components assembled end to end; the number of these components can, for example, be chosen to be identical to that of the panels 9 constituting the bottom 3, this number typically being three or four for the most common types of boat.

It is to be rioted that, here too, the rigid components of the hull are assembled end to end without this assembly being sealed. The lack of sealing in this place, combined with the aforesaid lack of sealing of the removable fixing means 8, leads to making provision for a sealed connection of one fender to the other, in the form of a flexible bottom 16, lining the rigid bottom 3 and underlying it, and fixed in a sealed manner to the two fenders 2 (FIG. 1 to 4).

Figure 5:
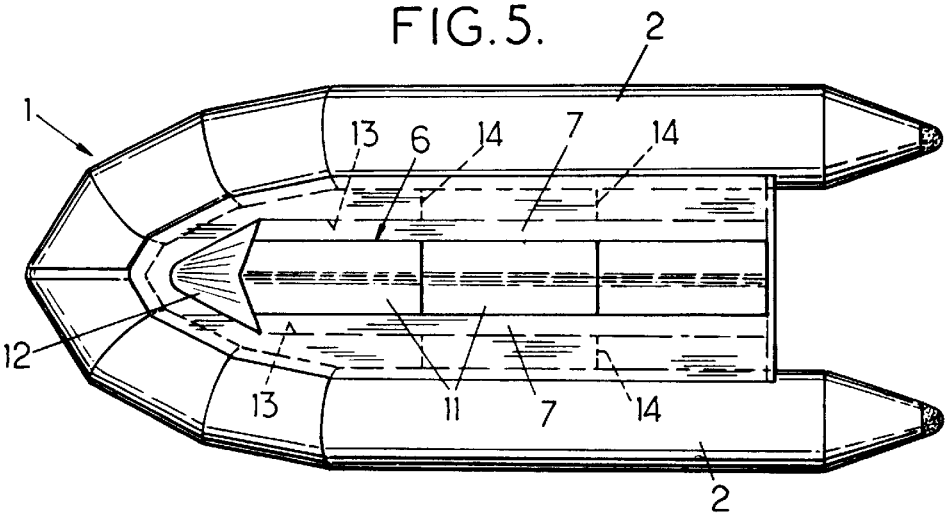
FIG. 5 is an underneath view of the boat of FIG. 4.
Figure 6:
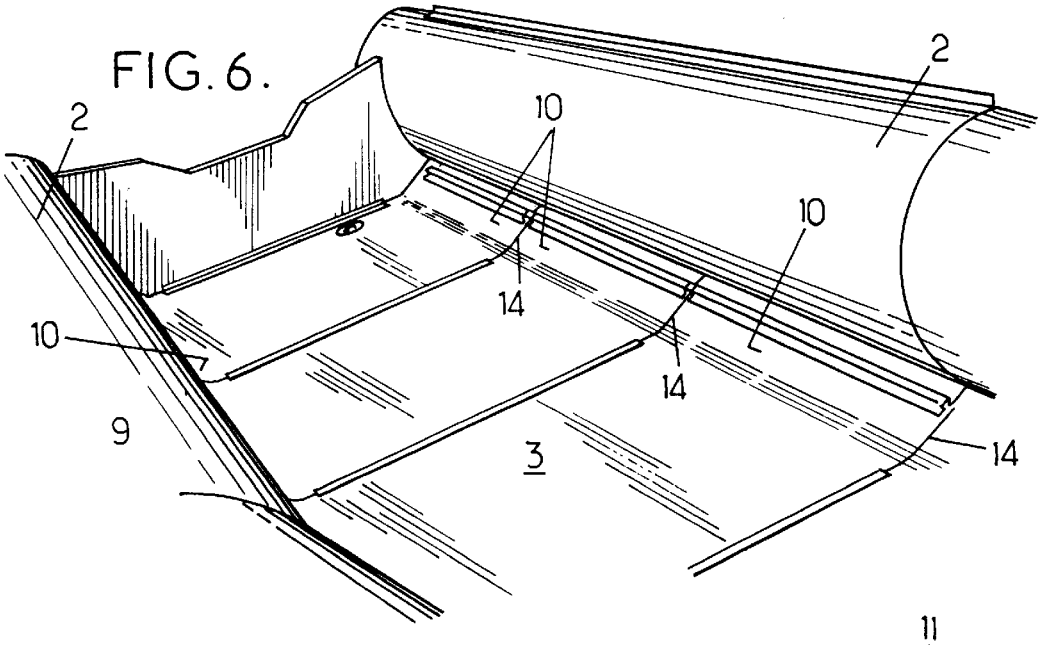
FIG. 6 is a partial top view, in perspective from front to rear, showing the interior of the boat of FIG. 5.

On FIG. 5 which is An underneath view of the boat of FIGS. 4 and 6, the rigid central strip 6 constituted, here, by three end to end components 11, as well as, on either side, the two flexible lateral strips 7 can be easily recognised.

In order to improve the front profile of the hull, a triangular canvas gusset 12, fixed to the lateral strips 7 which join at the front, covers the front end of the first component 11 of the gutter 6.

On this same FIG. 5, the lateral strips 7,which are applied against the edges 10 of the panels 9 of the bottom 3 and which exactly fit all the significant contours, make appear the impression of the curved rim 13 of the raised edges 10 (see FIG. 4) as well as impressions of the abutted edges 14 of the panels 9.

Figure 7:
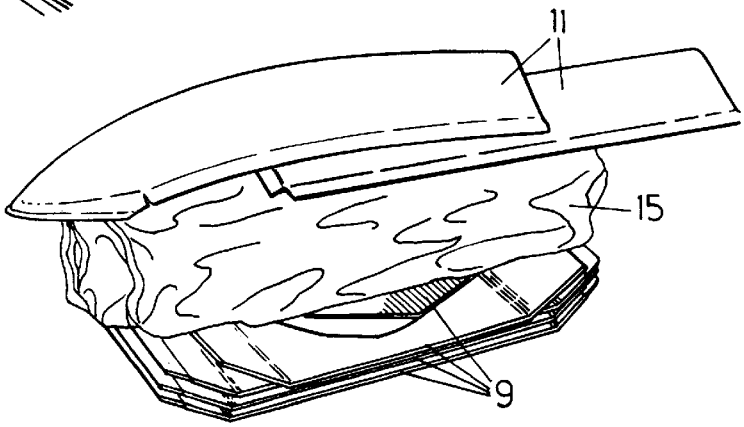
FIG. 7 is a perspective view of the boat of FIGS. 4 to 6 when dismantled, folded and rolled, arranged in the form of a package ready to be stowed and transported.

Given the specific layouts which have just been disclosed, the boat shown in FIGS. 4 to 6 can easily be dismantled: the constituent components 11 of the hull 4 are dismantled and stacked, the panels 9 constituting the bottom 3 are dismantled and stacked, the inflatable part is deflated , folded and rolled into a package 15 as illustrated in FIG. 7. Finally, all the assembled components form a compact package shown in FIG. 7, which can be easily stowed or transported without difficulty in a motor vehicle. On FIG. 7, will be noted the specific shape, longitudinally curved and tapered at its front end, of the front component of the hull 11.

However, the invention is not restricted to the previously described variants and methods of realisation and can give rise to other methods of realisation with a simplified and cost effective structure.

Figure 8:
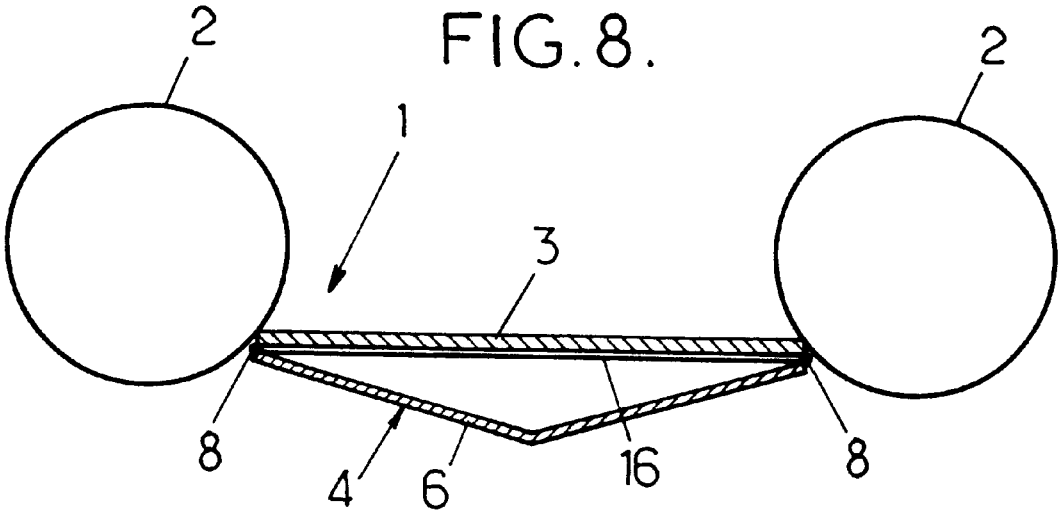
FIGS. 8 and 9 show, in a very schematic and simplified way two other possible realisation variants within the scope of the invention.

By referring to FIG. 8, the boat 1 is equipped with an entirely rigid hull 4, that is to say that its rigid part 6 extends, transversely, from one fender to the other, with fixing means 8 associated directly with the respective fenders 2.

The rigid part 6 is, as indicated above, constituted by several components assembled end to end. Because of the intrinsic rigidity of the hull and its lateral supports bearing directly on the fenders, it is not mandatory to resort to the installation of a keel. As a result there is a saving of one component piece which, in conjunction with the removal of the flexible lateral strips 7 envisaged above (see FIG. 1 to 4), contributes to a notable simplification of the structure and to an appreciably lower cost price.

Figure 9:
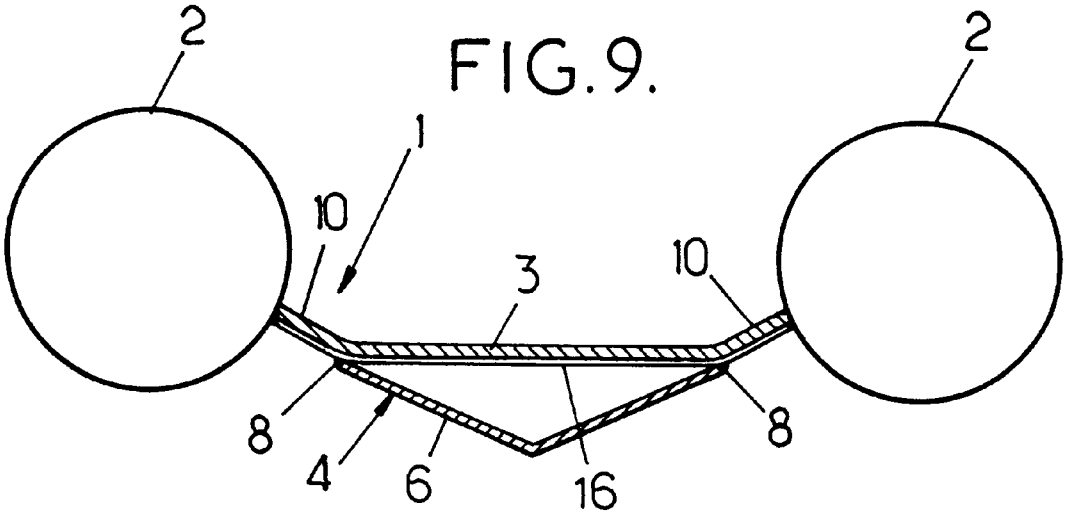

FIG. 9 illustrates a simplified layout which constitutes a compromise between the mode of realisation of FIG. 4 and the mode of realisation of FIG. 8. The boat 1 retains the rigid bottom 3 with raised lateral edges 10 of the layout of FIG. 4, with the flexible bottom 16 braced between the fenders 2 and closely fitting the contour of the lower face of the rigid bottom 3.

The hull 4 then comprises a rigid central strip 6 which is transversely dimensioned to correspond approximately with the connecting comers of the raised edges 10 of the rigid bottom 3 and of its central part. This rigid strip 6, constituted by abutted components, is connected directly onto the flexible bottom 16, the removable fixing means 8 being arranged opposite the angles of the rigid bottom. The hull 4 is then formed partly by the rigid central strip 6 and partly by the flexible bottom 16. Because of the tautness of the flexible bottom 16 on the rigid bottom 3, the rigid central strip 6 is fixed with no possibility of transverse or vertical movement:

the presence of a keel is not therefore essential. Here also, the simplified structure results in a lower cost price.

It goes without saying and it is already a consequence of what precedes that the invention is not in the least restricted to those of its methods of application and of realisation which have been more particularly targeted; it encompasses on the contrary all the variants.

I claim:

1. An inflatable boat comprising laterally two inflatable buoyancy fenders connected by a rigid bottom at least transversely and by an underlying hull presenting an approximately V transverse section, and in which a flexible bottom, lining the rigid bottom and underlying it, is fixed in a sealed way to the fenders and the hull is rigid at least in a central longitudinal strip in the shape of a V gutter and comprises several sections assembled longitudinally end to end in a removable way and held with the help of removable fixing means.

2. A boat in accordance with claim 1, in which the hull is entirely rigid and fixed to the fenders with the help of the removable fixing means, as a result of which it is possible not to have to install a keel between the hull and the rigid bottom.

3. A boat in accordance with claim 1, in which the hull is part flexible and part rigid and comprises two flexible lateral strips arranged on either side of the central longitudinal strip, each of the flexible lateral strips being fixed on one side to a respective longitudinal edge of the central longitudinal strip with the help of removable fixing means and on the other side to the respective buoyancy fender.

4. A boat in accordance with claim 3, in which the rigid bottom possesses upward raised lateral edges and presents, in transverse section, approximately the shape of a V with a truncated point, the inclination of the lateral edges being approximately identical to the inclination of the two flexible lateral strips of the hull.

5. A boat in accordance with claim 4, in which, on each inclined side of the hull, the width of the corresponding side of the central longitudinal strip and the width of the raised edge of the rigid bottom each represent approximately a third of the width of the inclined side of the hull.

6. A boat in accordance with claim 3, in which the two flexible lateral strips of the hull are distinct from the flexible bottom and in which a keel is interposed between the central longitudinal strip and the rigid bottom in order to tension the hull.

7. A boat in accordance with claim 6, in which the keel is pneumatically inflatable and includes at least one pneumatically inflated fender interposed between the rigid bottom and the central longitudinal strip of the hull.

8. A boat in accordance with claim 4, in which the two flexible lateral strips of the hull are comprised by the two lateral zones of the flexible bottom exactly fitting the raised lateral edges of the rigid bottom and in that the removable fixing means of the central longitudinal strip of the hull are situated approximately at right angles to the connecting corners of the raised lateral edges and to the central portion of the rigid bottom, as a consequence of which the central longitudinal strip of the hull is held by the flexible bottom tightly over the rigid bottom and a keel does not have to be installed.

9. A boat according to claim 1 in which the rigid bottom is constituted by several panels assembled longitudinally end to end.

10. A boat according to claim 1 in which the rigid bottom is a bottom inflatable under high pressure.

11. An inflatable boat comprising:

a. an inflatable portion defining at least left and right fenders;

b. an upper bottom having a rigid portion and positioned intermediate the left and right fenders;

c. a lower bottom having a flexible portion and (i) underlying the upper bottom and (ii) connected to the left and right fenders; and d. a hull, at least a central longitudinal portion of which is rigid, connected to at least one of (i) the left and right fenders or (ii) the lower bottom.

12. An inflatable boat according to claim 11 in which the lower bottom is sealed to the left and right fenders.

13. An inflatable boat according to claim 11 in which at least the central longitudinal portion of the hull comprises a plurality of detachable sections.

* * * * *

UNITED STATES PATENT AND TRADEMARK OFFICE

CERTIFICATE OF CORRECTION

PATENT NO. : 5,943,978
DATED : August 31, 1999
INVENTOR(S) : Gerard Garnier

It is certified that error appears in the above-identified patent and that said Letters Patent is hereby corrected as shown below:

Column 1, line 44, after "stowed" delete "end" and insert --and--

Column 2, line 44, after "and" delete "tile" and insert --the--

Column 6, line 7, after "is" delete "An" and insert --an--

Signed and Sealed this

Thirteenth Day of June, 2000

*Attest:*

Q. TODD DICKINSON

*Attesting Officer*

*Director of Patents and Trademarks*